US011357272B2

(12) United States Patent
Mendez

(10) Patent No.: US 11,357,272 B2
(45) Date of Patent: Jun. 14, 2022

(54) PROTECTIVE SKIN SHIELDS

(71) Applicant: Oscar Mendez, Redondo Beach, CA (US)

(72) Inventor: Oscar Mendez, Redondo Beach, CA (US)

( * ) Notice: Subject to any disclaimer, the term of this patent is extended or adjusted under 35 U.S.C. 154(b) by 746 days.

(21) Appl. No.: 15/982,505

(22) Filed: May 17, 2018

(65) Prior Publication Data

US 2018/0263309 A1 Sep. 20, 2018

Related U.S. Application Data

(63) Continuation-in-part of application No. PCT/US2017/031598, filed on May 8, 2017, which is a continuation-in-part of application No. 15/153,387, filed on May 12, 2016, now Pat. No. 10,070,673.

(60) Provisional application No. 62/511,284, filed on May 25, 2017, provisional application No. 62/163,894, filed on May 19, 2015.

(51) Int. Cl.
*A41D 13/00* (2006.01)
*A41D 13/11* (2006.01)

(52) U.S. Cl.
CPC ..... *A41D 13/1107* (2013.01); *A41D 13/1161* (2013.01); *A41D 2400/26* (2013.01)

(58) Field of Classification Search
CPC ... A61F 9/02; A41D 13/1107; A41D 13/1161; A41D 2400/26; G02C 7/16
See application file for complete search history.

(56) References Cited

U.S. PATENT DOCUMENTS 1,279,884 A * 9/1918 Roche ..... A41D 13/1184 2/206
1,582,164 A * 4/1926 Burstyn ..... A61F 9/029 128/863
2,281,129 A 4/1942 Wolff
2,498,668 A * 2/1950 Fitzsimmons ..... A41D 13/11 128/863
D158,020 S * 4/1950 Spier ..... D16/301
2,669,717 A * 2/1954 Diggs ..... G02C 11/00 2/9
2,858,539 A 11/1958 Carlson
2,954,027 A * 9/1960 Marasco ..... A61M 16/0683 128/206.28
3,011,170 A 12/1961 Lutz
3,298,031 A * 1/1967 Morgan ..... A41D 13/1184 2/9

(Continued)

OTHER PUBLICATIONS

International Search Report in PCT/US2017/031598 dated Aug. 8, 2017.

(Continued)

*Primary Examiner* — Richale L Quinn
(74) *Attorney, Agent, or Firm* — Howard Leslie Hoffenberg; IP and Business Law Offices of Howard L. Hoffenberg, Esq.

(57) ABSTRACT

A device for providing solar and ultraviolet radiation protection to facial skin. The device has a configuration at a high level of abstraction that resembles eye glasses. The device is comprised of symmetrical halves. In one embodiment, each of the symmetrical halves is comprised of a noise bridge having a flexible and resilient vertex and extension arms, a cheek shield and a temple arm.

8 Claims, 5 Drawing Sheets

(56) References Cited

U.S. PATENT DOCUMENTS 3,346,875 A * 10/1967 Weisberger ..... G02C 11/00 2/9
3,721,490 A 3/1973 Prince
3,991,753 A * 11/1976 Viesca y Viesca ..... A41D 13/1184 128/201.12
4,105,304 A 8/1978 Baker
4,298,991 A 11/1981 Recenello
D290,964 S 7/1987 Kalbach
4,821,340 A * 4/1989 Johnson ..... A61F 9/029 2/9
4,877,320 A 10/1989 Holden
4,944,039 A * 7/1990 Dietrich ..... A61F 9/029 2/13
5,005,214 A 4/1991 Koethe
D323,570 S * 1/1992 Jacobson ..... D16/330
5,335,025 A 8/1994 Wang
5,428,706 A 6/1995 Lequeux
5,471,679 A * 12/1995 Paoluccio ..... A41D 13/1184 2/9
5,488,441 A * 1/1996 Pomatti ..... G02C 3/003 2/452
5,561,863 A * 10/1996 Carlson, II ..... A41D 13/1115 128/206.19
5,570,705 A * 11/1996 Burke ..... A41D 13/1161 128/869
5,666,664 A * 9/1997 Hamilton ..... G02C 9/04 2/13
5,704,063 A * 1/1998 Tilden ..... A41D 13/1107 2/9
D408,432 S * 4/1999 Jumara ..... D16/315
6,540,347 B1 4/2003 Radziwon
RE38,764 E 7/2005 Hirschman
D569,413 S 5/2008 Wong
7,862,165 B2 1/2011 Hobbs
8,387,163 B2 * 3/2013 Beliveau ..... A41D 13/11 2/9
D711,449 S * 8/2014 Huschka ..... D16/101
D735,318 S * 7/2015 Roblin-Lee ..... D24/110.1
D759,744 S * 6/2016 Rigas ..... D16/315
D781,503 S * 3/2017 Rose ..... D29/108
D805,124 S * 12/2017 Mendez ..... D16/332
D817,477 S * 5/2018 Han ..... D24/110.1
D822,094 S * 7/2018 Astapenko ..... D16/302
10,070,673 B2 * 9/2018 Mendez ..... G02C 11/12
D849,814 S * 5/2019 Huschka ..... D16/101
10,575,514 B1 * 3/2020 Sasaki ..... A41D 13/001
2008/0301846 A1 * 12/2008 Brillouet ..... B01L 3/508 2/13
2009/0151744 A1 * 6/2009 Villanueva ..... A45D 44/12 132/319
2011/0088716 A1 * 4/2011 Villanueva ..... A45D 44/12 132/319
2011/0239347 A1 * 10/2011 Beliveau ..... A41D 13/11 2/9
2013/0100397 A1 * 4/2013 Farnam ..... G02C 5/20 351/118
2014/0146282 A1 * 5/2014 Lu ..... G02C 5/045 351/118
2014/0340629 A1 11/2014 Sadler
2016/0016370 A1 * 1/2016 Sheldon ..... G02C 5/02 351/178
2016/0139430 A1 * 5/2016 Rigas ..... G02C 5/001 2/12
2016/0338429 A1 * 11/2016 Mendez ..... A41D 13/1161
2018/0024382 A1 * 1/2018 Rigas ..... G02C 7/10 351/47
2019/0346696 A1 * 11/2019 Rigas ..... G02C 9/02

OTHER PUBLICATIONS

Opinion of the International Search Authority in PCT/US2017/031598 dated Aug. 8, 2017.

* cited by examiner

PROTECTIVE SKIN SHIELDS

CROSS-REFERENCE TO RELATED APPLICATIONS

This application claims priority from U.S. Provisional Application Ser. No. 62/511,284 which was filed on May 25, 2017. The entirety of U.S. Provisional Application Ser. No. 62/511,284 which was filed on May 25, 2017 is incorporated herein by reference. Said provisional application claims priority from U.S. Design patent application Ser. No. 29/580,965 filed on Oct. 14, 2016. The entirety of U.S. Design patent application Ser. No. 29/580,965 which was filed on Oct. 14, 2016 is incorporated herein by reference. This application claims priority from co-pending U.S. patent application Ser. No. 15/153,387 which was filed on May 12, 2016. The entirety of co-pending U.S. patent application Ser. No. 15/153,387 which was filed on May 12, 2016 is incorporated herein by reference. Said co-pending Patent application claims priority from U.S. Provisional Application Ser. No. 62/163,894 which was filed on May 19, 2015 and now expired. The entirety of U.S. Provisional Application Ser. No. 62/163,894 which was filed on May 19, 2015 is incorporated herein by reference. This application claims priority from co-pending PCT Request US2017/031598 having an international filing day of 8 May 2017 with a priority date of 12 May 2016. The entirety of co-pending PCT Request US2017/031598 having an international filing day of 8 May 2017 is incorporated herein by reference. Said PCT Request claims priority from co-pending U.S. Patent application Ser. No. 15/153,387 which was filed on May 12, 2016. The entirety of co-pending U.S. patent application Ser. No. 15/153,387 which was filed on May 12, 2016 is re-incorporated herein by reference.

BACKGROUND OF THE INVENTION

1. Field of the Invention

This invention pertains generally to devices for providing solar and ultraviolet radiation protection to facial skin and more particularly, this invention is directed to facial accessories that provide from sunlight and other harmful ultraviolet radiation.

2. Related Art

When exposed to harmful ultraviolet radiation from the sun or other source, an alarm-like system is triggered in skin cells that excites melanin production. Melanin is a darkening pigment. Melanin production is an immune-like defense system to harmful radiation.

Like any triggering of an immune-like defense system, the triggering of the melanin defense system can under-estimate or over-estimate the radiation threat. In an individual with lighter skin, the threat is under-estimated and the more the damage to that individual's skin by sun. If the threat is over-estimated, the melanin defense system stays active constantly, or nearly constantly, and is too powerful. This can give rise to abnormalities like age spots and moles.

By reason of sun exposure, in areas around eyes, premature lines become visible. The sun's rays penetrate delicate tissue around the eyes and trigger the gradual elimination of connective tissue such as collagen. Premature lines take place as compromised collagen loses its elasticity.

Melasma is a major setback to skin condition and appearance from sun exposures. Melasma is a darkening of the skin that resembles a cloud. Typically, melasma begins in the temple area and around the eyes and slowly spreads to the upper cheeks, nose and forehead. The melasma skin disorder afflicts millions of people and especially women. Melasma can occur in individuals as young as in their early twenties.

In the long run, sun damage to skin triggers more detrimental damage to skin appearance; for example, age spots and moles, as mentioned above. Age spots and moles form as skin tissue attempts to contain damage from solar radiation.

Under the present state of the art, once the skin is damaged, that individual is left to rely on the therapeutic options of creams and procedures that can alter the individual's face features. Individuals affected with melasma treat the disorder by applying bleaching agents that lighten the skin, but, leave the skin more susceptible to damage by solar radiation. An individual whose skin has been treated with lightening products must be more vigilant to avoid sun exposures for this might turn the skin even darker. As the darkening of skin continues from want of sun protection, sufferers seek treatments of chemical peels, lasers and higher and stronger bleaching creams. These treatment options increase skin susceptibility to the sun and can be self-defeating in that the end result is a more permanent melasma condition, or in some cases, cancer.

Through the years, sun protective creams and devices have been developed for providing solar radiation protection to facial skin for those who suffer from solar skin disorders. Sun protective creams have the disadvantages of being oily, messy and shiny. This is an inconvenience especially not appealing to younger individuals. Women who were makeup prefer not to apply sun protective creams because, it will mix with makeup to generate a thick and messy mixture. Further, some individuals develop irritation in their eyes because, the sun protective cream runs down to their eye area. In some cases, the sun protective cream causes an allergic reaction to the individual's skin.

Sun protection creams have additional disadvantages as follows. The application of sun protection creams has to be done a few times a day to ensure effectiveness. To light skin individuals, applying sun protection creams on their faces gives their face a translucent look. To darker skin tone individuals, applying sun protection creams gives their face the look of having a blueish coat and/or a hue appearance. Lastly, there are manufacturers who over rate their sun protective creams to the detriment of users who do not know that the protection claims are over estimated.

Hats and visors provide solar radiation protection. They have the disadvantages of being an unwanted accessory. For some woman, hats are unwanted because, they undo a hair style. The use of visors is unwanted because, they are not trendy by standards of contemporary fashion. Hats that carry skirts provide side sun protection. Individuals find such hats to be uncomfortable and sweaty. This is particularly so for individuals in temperatures exceeding 90 degrees Fahrenheit where individuals prefer not to wear extra garments on themselves. In addition to annoying extra heat, hats that carry skirts pose an unnecessary risk of reducing needed visibility when driving, especially in heavy traffic.

Latex and elastic masks provide solar radiation protection. These masks encase and conform fit to a head with openings for eyes, noses, mouth and ears. This is an unorthodox approach to protecting a face against the sun. Latex masks pose discomfort by virtue of encasing facial skin. Such masks are laced with an unkind stereotype and obloquy by contemporary standards.

Blockers provide protection from solar radiation. Blockers include placing towels or other objects on windows to block the sun. This has the disadvantages of impeding visibility and presents a risk to drivers. This alternative is limited to individuals who are in a confined place.

Recently as relative to the filing of this present application, the art was advanced by United States Patent Application Publication 2016/0338429 A1 which is incorporated by reference. In this patent publication, there is a disclosure of a protective skin shields (10) that is mounted to eyeglasses worn by a user. The major components are a means for mounting, an interconnector and shields. The invention solves technological problems, inter alia, of bilaterally protecting the cheek, temple and forehead region of a user's face from harmful sun radiation without the use of hats, skirts, blockers and/or chemicals.

There exists a need for a facial accessory that is independent of and does not mount on eye glasses or sunglasses that is fashionable, convenient and effective device that provides substantial protection from sunlight and other harmful radiation to regions of a face.

The present invention satisfies these needs, as well as others, and generally overcomes the presently known deficiencies in the art.

SUMMARRY OF THE INVENTION

The present invention is directed to a protective skin shields. The intended user is human a user characterized as having a face with a nose, eyes, eye orbitals, cheek region, a temple region and a forehead region. Notwithstanding, within the spirit of the invention, human user would also encompass other primates, animals and aliens that have faces having characteristics bearing similarities to that of a human face.

An object of the present invention is to provide substantial protection to shield regions a face from sunlight and other harmful ultraviolet radiation.

An object of the present invention is to provide protection to shield regions of a face from sunlight and other harmful ultraviolet radiation that surpasses sun protection factor (SPF) nomination of about 100 without chemicals and/or lotions.

An object of the present invention is a protective skin shields (10) that is a facial accessory and independent of commonly worn eyeglasses or sunglasses.

An object of the invention is an extension of eyeglasses that provides protection beyond the orbital region of the eyes and extends to the cheek region.

A further object of the invention is a facial accessory that provide substantial protection from solar and other ultraviolet radiation that is stable and comfortable when worn on a user's face which is subjected to jolting and wind resistance.

A further object of the present invention is a facial accessory that maintains a thermal environment between the facial accessory and the user's face that is comfortable to the user.

The invention is an apparatus that is a facial accessory that provides substantial bilateral protection from sunlight and other harmful ultraviolet radiation in the eye orbital and cheek regions of a user's face and optionally in the temple region. The apparatus has a configuration at a high level of abstraction and in a broad conceptual sense that resembles eye glasses. The apparatus is conceptualized as having symmetrical halves. Each of the symmetrical halves is comprised of a half a noise bridge (vertex and extension arm,) a cheek shield, optionally a temple shield and optionally a temple arm. The cheek shield and cheek shield with a temple shield appendage preferably have a shape and topography, that is a concave-like inner surface, to conform to a cheek or temple, respectively, so as to fit against said region. Preferable, the shields are aerodynamically configured.

In preferred embodiments of the invention, the vertex has a "V"-like or "U"-like configuration and is resilient. The terminuses of the extension arms are spaced apart like that in typical eyeglasses. However, unlike typical eye glasses, the distance between the terminuses of the extension arms is less than that that of the width or breath of a user's nose. Accordingly, when a user dons the protective skin shields, the extension arms are spread apart. The resilient vertex reacts by urging the extension arms towards each other. The cheek shields are pressed against the user's face contacting the user's face and its boundary edge or optionally, at upper and/or lower contact points/pads. This in turn has a stabilizing effect of the skin shields on the user's face. In Embodiments of the invention, the stabilizing effect is of sufficient magnitude that temple arms are not deployed.

In more detail, one aspect of the invention is a facial accessory for a human user that provides bilateral protection from sunlight and other ultraviolet radiation. This aspect of the invention is comprised of a nose bridge having a central vertex region and a pair of extension arms with each extension arm extending from the central vertex region to a terminus and there being a spread distance between the terminuses. There is a pair of cheek shields with each cheek shield having lateral surfaces and an outer boundary edge with each of the cheek shields connected to the terminus of an extension arm. The connection between the extension arm and cheek shield orients the cheek to have frontal, rearward, upper and inner facing directions. There is a pair of temple arms extending away from the rearward boundary of each of the cheek shields a distance so as to be capable of resting on the top of a user's ears. Optionally, the temple arm can have a hook region for engaging the user's back ear.

Another aspect of the invention is facial accessory for a human user that provides bilateral protection from sunlight and other ultraviolet radiation. This aspect of the invention is comprised of a nose bridge having a central vertex region that is resilient and a pair of extension arms which each extend from the central vertex region to a terminus and there being a spread distance between the terminuses. There are a pair of cheek shields where each cheek shield has a plate-like structure, lateral surfaces, an outer boundary edge, defined to have frontal, rearward, upward and inner facing directions, a curvature so that the inner surface is capable of wrapping around the front of a user's face with a portion overlaying a user's cheek with said inner surface being concave-like to approximately conform to the topology of the cheek region of a user where each of the pair of cheek shields is connected to one of terminuses of the pair of extension arms. Accordingly, when the pair of extension arms are in a state of having an increased spread distance between their terminuses there is a force urging the cheek shields inward that presses the pair of cheek shields against the face of a user to have some stabilizing effect of the facial accessory on the face of the user.

There are a pair of temple arms extending away from the rearward boundary of each of the cheek shields where each temple arm extends a distance so as to be capable of resting on the top of a user's ears, has a hook region capable of engaging the rear of a user's ear and an extension length adjusting means for adjusting the distance that the temple arm extends between the rearward boundary of the cheek shield and the back of a user's ear. Preferably, the extension length adjusting means is comprised of a row of a plurality of spaced apart holes and a corresponding row of a plurality of spaced apart posts with posts conformingly fitting into holes with a friction fit whereby the distance that the temple arm extends between the rearward boundary of the cheek shield and the back of a user's ear can be adjusted by selecting which posts are fitted into which holes.

Preferably, the facial accessory has a cheek shield with at least one vent opening whereby there is cooling between a user's cheek and the cheek shield. Optionally, the facial accessory has a cheek shield with a temple shield appendage. In general terms, a temple shield appendage is and upwardly directed shield that overlays a portion of a user's temple region.

Another aspect of the invention is a method for shielding and shading from sun light and other harmful ultraviolet radiation the face of a user. One step of the method is providing a protective skin shields. Another step is donning the protective skin shields.

The previously described versions of the present invention has many advantages which include protection from solar and other harmful radiation of more vulnerable areas of the face that are susceptible to developing melasma, age spots, moles and premature wrinkles.

BRIEF DESCRIPTION OF THE DRAWINGS

These and other features, aspects and advantages of the present invention will become better understood with reference to the following description, appended claims and accompanying drawings where:

DETAILED DESCRIPTION OF THE INVENTION

Figure 1:
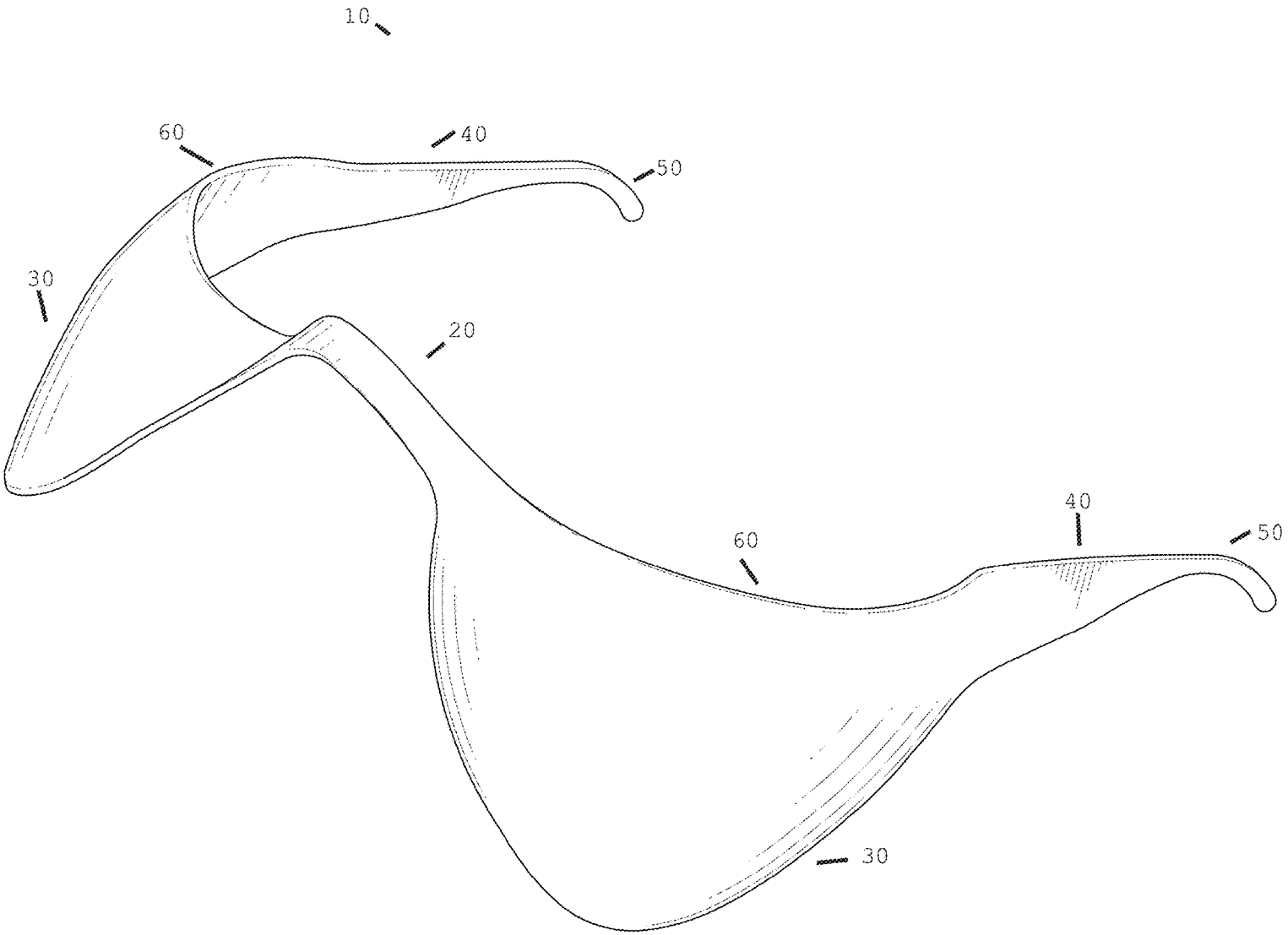
FIG. 1 is a perspective view of the Protective Skin Shields according to the present invention looking from the outside.

The present invention is described more fully in the following disclosure. In this disclosure, there is a discussion of embodiments of the invention and references to the accompanying drawings in which embodiments of the invention are shown. These specific embodiments are provided so that this invention will be understood by those skilled in the art. This invention is not limited to the specific embodiments set forth herein below and in the drawings. The invention is embodied in many different forms and should be construed as such with reference to the appended claims.

Referring to FIG. 1, in general terms and for an overview of the protective skin shields (10), embodiments of this invention are comprised of the following major components: (i) noise bridge (20), (ii) a cheek shield (30) and (iii) optionally temple arms (40).

The protective skin shields (10) is worn on a human user's face. A human user's face is characterized as having a face with a nose, eyes, eye orbitals, cheek region, a temple region and a forehead region. The wearing on a human user's face defines a forward or frontal portion/direction, rearward portion/direction, an upper portion/direction, a lower portion/direction, an inner surface/direction and an outer surface/direction. Notwithstanding the typical literal meaning of the term "human," within the spirit of the invention, human user would also encompass other primates, animals, aliens and supernatural creatures which may come to Earth that have faces having characteristics bearing similarities to that of a human face.

Continuing to refer to FIG. 1, there is a nose bridge (20) having a central vertex region and a pair of extension arms with each extension arm extending from the central vertex region to a terminus and there being a spread distance between the terminuses. As with a standard nose bridge in eyeglasses, the vertex typically has a "U"-like or "V"-like configuration. While the terminuses of the extension arms are spaced apart like that in typical eyeglasses, unlike typical eye glasses, in preferred embodiments, the vertex is flexible and resilient with the distance between the terminuses of the extension arms being less than that that of the width or breath of a user's nose.

Accordingly, when a user dons the protective skin shields (10) on the user's nose, the terminuses of the extension arms (40) are spread further apart.

As mentioned, preferably, the vertex region is flexible whereby the spread between the terminuses of the pair of extension arms can be increased and decreased. More preferably, the vertex region is resilient whereby when the pair of extension arms are in a state of having an increased spread distance between their terminuses there is a force urging the cheek shields inward that presses the pair of cheek shields against the face of a user to have some stabilizing effect of the facial accessory on the face of the user.

Preferably, the nose bridge (20) is a nose bridge have elongated extension arms compared to that in common glasses. Elongated extensions compared to that in the nose bridge of commonly worn eye glasses both allows for proper positioning of the cheek shields (30) on a user's face to overlay the cheek and acts as levers to maximize the central vertex region inwardly biasing and urging the cheek shields (30) towards a user's face to stabilize the device on the user's face.

Continuing to refer to FIG. 1, the cheek shield (30) is a plate-like structure. The plate-like structure has length, breadth, a peripheral or boundary edge, thickness and two oppositely opposed surfaces. The plate-like structure has the property of impeding the transmission of sun light and/or other ultraviolet radiation (discussed further below.) Depending on the material out which the cheek shield (30) is made (discussed below,) the thickness of the cheek shield (30) is typically between about 1/32 of an inch to about a 1/4 of an inch. A thicker thickness is preferred for a more robust property of impeding sun light transmission and/or other ultraviolet light transmission. A thinner thickness is preferred for a more robust exchange of heat through the shield to reduce a heat build-up between the user's face and the inner surface of the shield. A thinner shield also keeps down weight for greater comfort by a user. These factors are balanced to achieve a desired overall performance.

The cheek shield (30) is preferable fabricated from plastics such as polyethylene, polypropylene, polyvinyl chloride, polycarbonate and polyamides. A low-density material is preferred to keep down the weight of the shield and provide more comfort for a user when wearing the protective skin shields (10). With 3D printing technology evolving, the materials used in 3D printing and the method of 3D printing are viable for fabrication may become preferred for fabrication.

In preferred embodiments, the shield is made from a flexibly deformable plastic that has a modulus of flexibility such that it is bendable to reduce the potential for face cutting in the event of impact. In alternative embodiments of the invention, colorants and light absorbing dopants can be added to the plastic to reduce or essentially completely prevent the transmission of sun light or other ultraviolet radiation. In an alternative embodiment, the cheek shield (30) can be fabricated from a bilayer of polarized material oriented out of phase; paper products; linens and/or metals.

Figure 2:
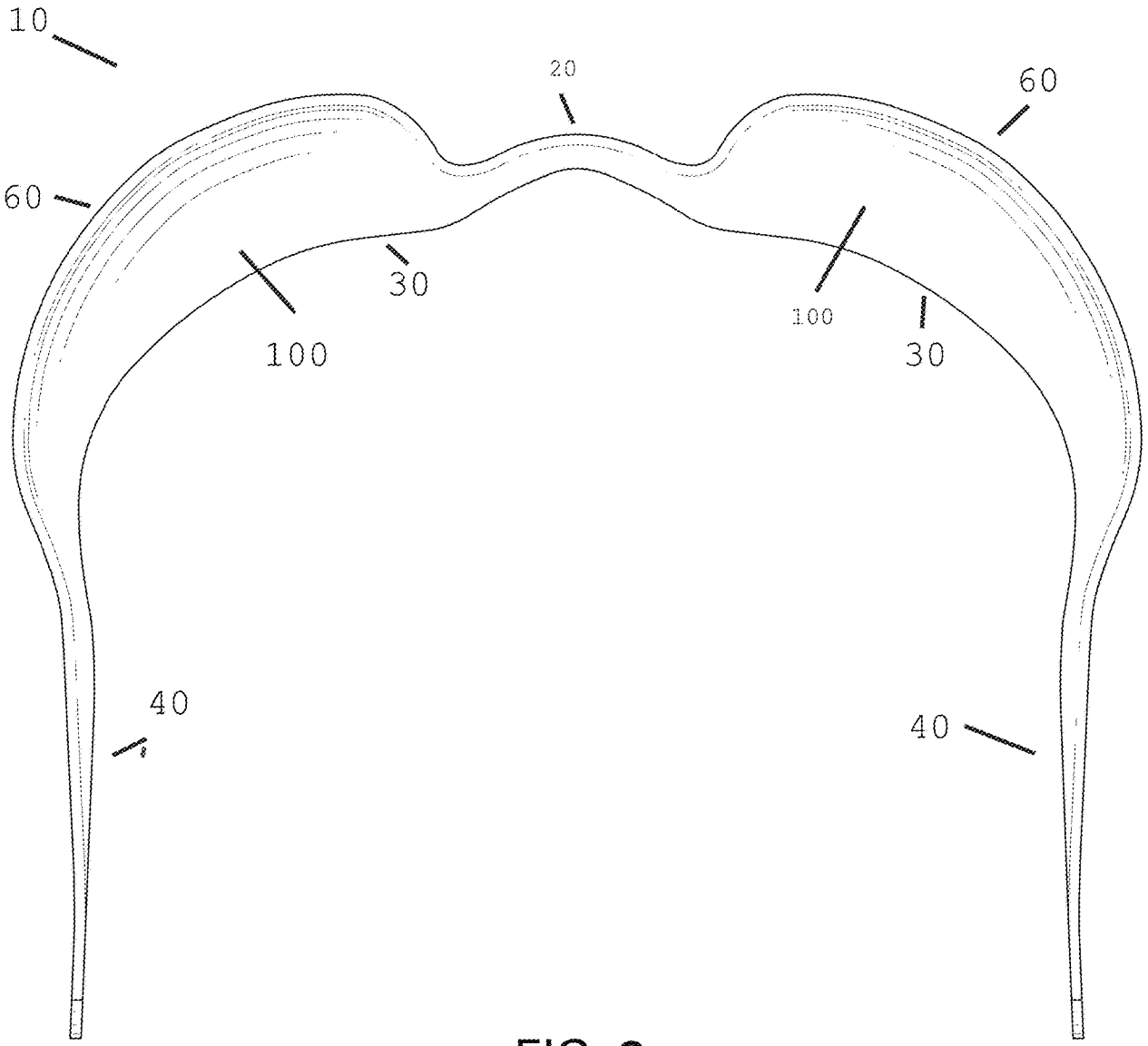
FIG. 2 is a perspective view of the Protective Skin Shields according to the present invention looking from the inside.
Figure 3:
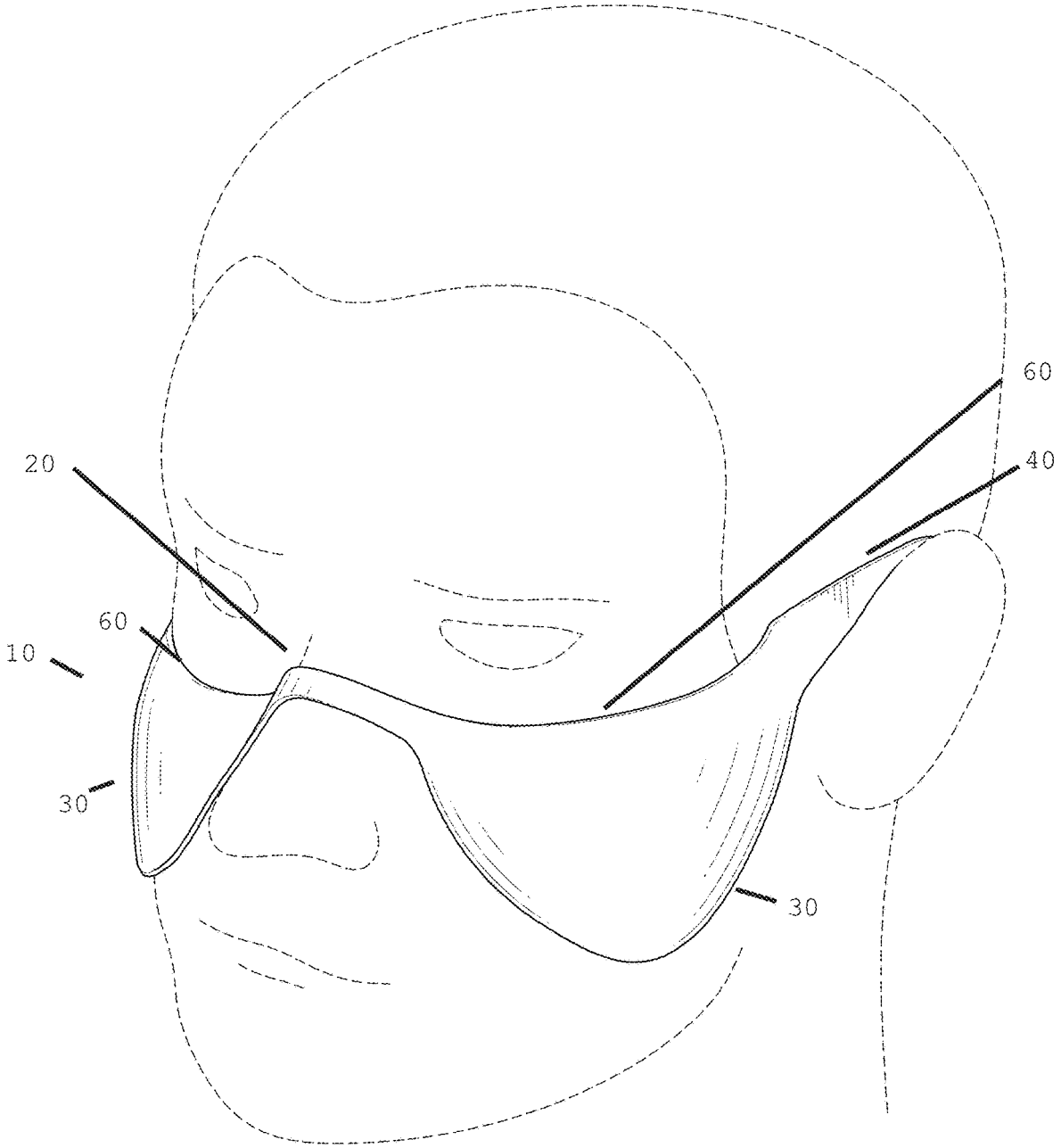
FIG. 3 is a perspective view of the Protective Skin Shields according to the present invention as being worn by a user where the broken lines depicting a human head shown throughout of the drawing are for illustrative purposes only and form no part of the claimed design.

Referring to FIGS. 1-3, the plate-like structure has a curvature complementary to a user's face and wraps around the front of a user's face. In preferred embodiments, the inner surface is concave-like to accommodate the topography of a user's face and thereby conformably and stably rest on a user's face. The plate-like structure has shape so as overlay a user's cheek or significant portion of a user's cheek and can have a lower edge that follows a jaw bone line. The cheek shield (30) portion contacts a user's face at its boundary edge. Optionally, it can have a contact point or region to the cheek of a user so as to create lower contact point or region on the cheek of a user. In preferred embodiments, the inner topography to conform to a cheek is augment by an outer topography that is an aerodynamic configuration to reduce wind drag. This helps stabilize the protective skin shields (10) on a user's face Referring to FIG. 3, in a most preferred embodiment, the extension arms are of suitable length so that an upper boundary of the cheek shield (30) follows approximately along the zygomatic arch of a user and the inner surface with a concave-like inner surface to approximately conform to the topology of the cheek region of a user. The result being enhanced stabilization on a user's face.

Figure 4:
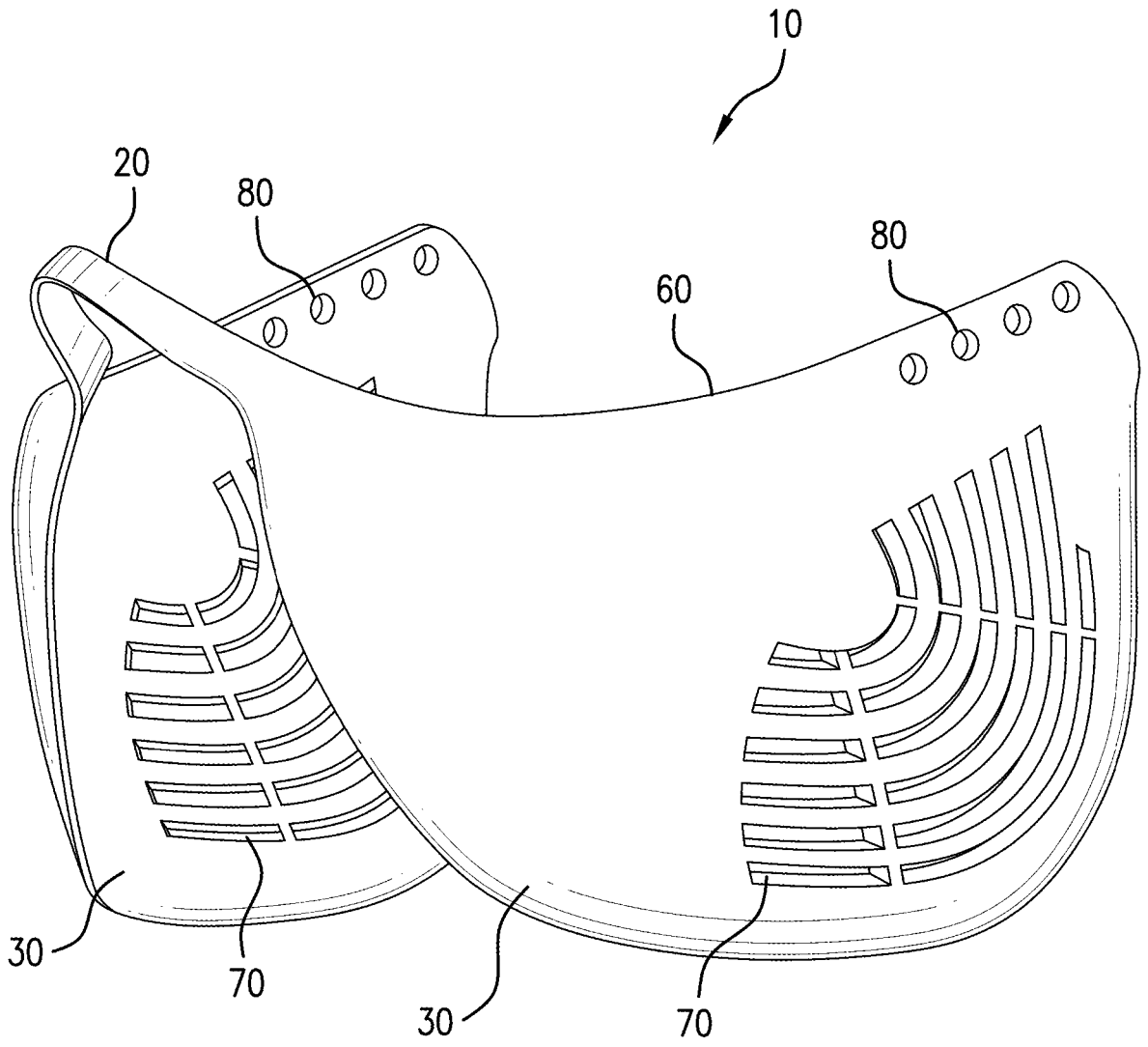
FIG. 4 is a perspective view of the Protective Skin Shields according to the present invention and FIG. 5 is a perspective view of a temple arm with a plurality of posts according to the present invention.

Referring to FIG. 4, in preferred embodiments, the cheek shield (30) has at least one vent opening (70) whereby there is cooling between a user's cheek and the cheek shield. The ventilation openings or heat diffusers (70) enhance the influx of cool air to a space between the inner surface of the shield and a user's face. The ventilation openings or heat diffusers (70) also allow for an out flux of hot air and sweat that may build up between the inner surface of the shield and a user's face. The ventilation openings or heat diffusers (70) can be circular, a slit, a polygon, an irregular shape and/or a combination of the foregoing. In a preferred embodiment, the ventilation openings or heat diffusers (70) are slits. In alternative embodiments, the ventilation openings or heat diffusers (70) can be in fluid communication with longitudinal channels fashioned into the inner surface of the shield that run along the surface so as to disburse cooling air to particular points spaced throughout the inner surface of the shield.

Optionally, the cheek shield can have an upward appendage to overlay a portion of the temple region of a user (not illustrated.) This appendage can be configured to conform to the topography of a user's temple region.

Not illustrated and optionally, the shield can be shaped, textured, colored, painted and/or decorated to have an attractive appearance. Users can decide from a large variety of designs, according to taste and fancy. Decorations and shaping include gothic, medieval, futuristic and robotic themes.

Referring to FIGS. 1-3, optionally, there can be a pair of temple arms (40) extending away from the rearward boundary of each of the cheek shields (30) a distance so as to be capable of resting on the top of a user's ears. The temple arm (40) is similar at a high level of abstraction and conceptualization to the temple are of eye glasses. It extends along the side of the users face and has a hook region to engage the ear of a user. Referring to FIG. 1, optionally, the temple arm 30 has a hook region (50) capable of engaging the rear of a user's ear.

Figure 5:
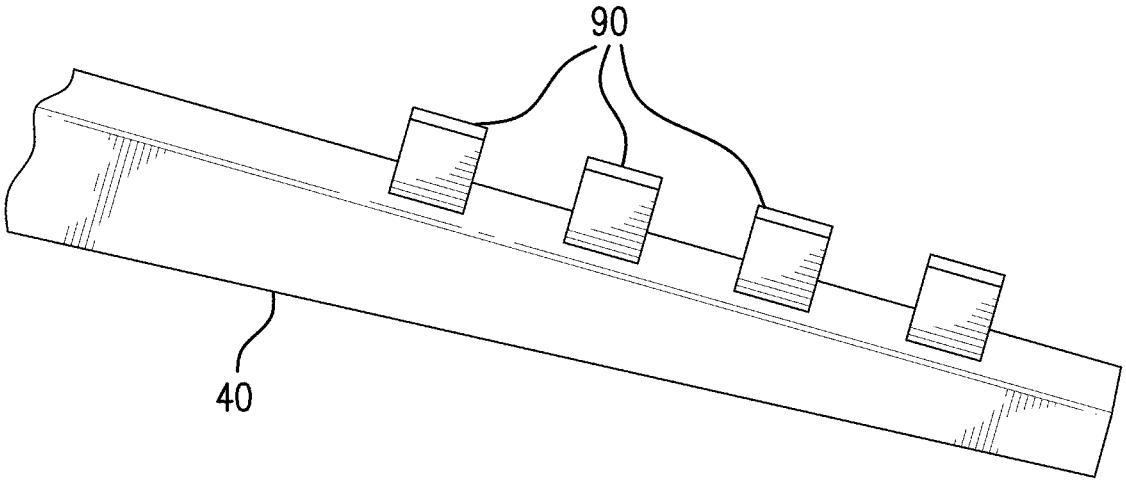

Referring to FIGS. 4 and 5, in preferred embodiments having temple arms (40) there an extension length adjusting means for adjusting the distance that the temple arm extends between the rearward boundary of the cheek shield and the back of a user's ear. One physical structure (not illustrated) is a two-piece temple arm with one larger piece having perimeter tracking in which a smaller piece frictionally slides. Optionally, there can be a locking or clamping mechanism. Another physical structure is a temple arm with a friction ridden elbow joint (not illustrated.) This physical structure functions along the lines of a hypotonus triangle. The greater the bend angle, the shorter the distance from the rearward edge of the cheek shield (30) to the back of a user's ear. Optionally, there can be a locking or clamping mechanism.

Referring to FIGS. 4 and 5, in most preferred embodiments, the extension length adjusting means is comprised of a row of a plurality of spaced apart holes (80) and a corresponding row of a plurality of spaced apart posts (90) with posts (90) conformingly fitting into holes (80) with a friction fit whereby the distance that the temple arm (40) extends between the rearward boundary of the cheek shield (30) and the back of a user's ear can be adjusted by selecting which posts (90) are fitted into which holes (80).

Not illustrated, alternative versions of the protective skin shields (10) have compatible capabilities to smart phones, skin cell moistening systems, cooling systems, heat defusing systems, a measuring system that would advise a user of an extreme heat condition and/or a system that provides feedback of how much sun radiation has been repelled. An alternative version of the invention has the morphing capability of retractable shields that can be controlled by the user.

The invention is used to shield and shade from sun light and other harmful ultraviolet radiation the face of a user. A user is providing a protective skin shields (10). The user dons the protective skin shields (10).

An alternative embodiment of the present invention is a method for shading the face of an user from solar and/or other ultraviolet radiation. The method is comprised of the following steps:

a. providing a protective skin shields (10) as disclosed above;

b. donning the protective skin shields (10).

The previously described versions of the present invention have many advantages. One advantage of the protective skin shields (10) is protecting from solar radiation and/or other harmful ultraviolet radiation areas of the face that are susceptible to developing melasma, age spots, moles and/or premature wrinkles. The protective skin shields (10) is a practical device to shade against lateral and frontal sun exposure.

Another advantage of the protective skin shields (10) is that it is a solar radiation and/or other harmful ultraviolet radiation blocker without adding a heat build-up element and/or an unfashionable element by contemporary standards.

Another advantage is that a protective skin shields (10) can be readily fabricated using commonly available materials and equipment based upon that which is available in the contemporary economy.

Another advantage is that a protective skin shields (10) can be inexpensive based upon that which is commonly available in the contemporary economy.

Another advantage arises from ozone layer depletion. As the ozone layer is depleted, ultraviolet radiation increases. A pair of sunglasses offers limited protection. The protective skin shields (10) provides a sun protection to a younger generation being exposed to greater ultraviolet radiation, as well as bring benefits to mature users.

Although the present invention has been described in considerable detail with reference to certain preferred versions thereof, other versions are possible with substituted, varied and/or modified materials and/or substituted, varied and/or modified steps are employed. These other versions do not depart from the invention. Therefore, the spirit and scope of the appended claims should not be limited to the description of the preferred versions contained herein.

I claim:

1. A facial accessory for a human user that provides bilateral protection from sunlight and other ultraviolet radiation comprised of:

a A nose bridge having a central vertex region that is resilient and a pair of extension arms which each extend from the central vertex region to a terminus and there being a spread distance between the terminuses and b a pair of cheek shields where each cheek shield has a plate-like structures, lateral surfaces, an outer boundary edge, defined to have frontal, rearward, upward and inner facing directions, a curvature so that the inner surface is capable of wrapping around the front of a user's face with a portion overlaying a user's cheek with said inner surface being concave-like to approximately conform to the topology of the cheek region of a user so as to provide a of user with substantial protection to shield regions a face from sunlight and other harmful ultraviolet radiation where each of the pair of cheek shields is connected to one of terminuses of the pair of extension arms, the pair of cheek shields, the nose bridge and the pair of extension arms comprise a continuous one piece construction of a same material whereby the facial accessory is adapted for when the pair of extension arms are in a state of having an increased spread distance between their terminuses there is a force urging the cheek shields inward that presses the pair of cheek shields against the face of a user to have some stabilizing effect of the facial accessory on the face of the user.

2. The facial accessory of claim 1 where the cheek shield has at least one vent opening whereby there is cooling between a user's cheek and the cheek shield.

3. The facial accessory of claim 1 having a pair of temple arms extending away from the rearward boundary of each of the cheek shields a distance so as to be capable of resting on the top of a user's ears.

4. The facial accessory of claim 3 where the temple arm has a hook region capable of engaging the rear of a user's ear and there is an extension length adjusting means for adjusting the distance that the temple arm extends between the rearward boundary of the cheek shield and the back of a user's ear.

5. The facial accessory of claim 4 where the extension length adjusting means is comprised of a row of a plurality of spaced apart holes and a corresponding row of a plurality of spaced apart posts with posts conformingly fitting into holes with a friction fit whereby the distance that the temple arm extends between the rearward boundary of the cheek shield and the back of a user's ear can be adjusted by selecting which posts are fitted into which holes.

6. A facial accessory for a human user that provides bilateral protection from sunlight and other ultraviolet radiation comprised of:

a A nose bridge having a central vertex region that is resilient and a pair of extension arms which each extend from the central vertex region to a terminus and there being a spread distance between the terminuses;

b a pair of cheek shields where each cheek shield has a plate-like structures, lateral surfaces, an outer boundary edge, defined to have frontal, rearward, upward and inner facing directions, a curvature configured so that the inner surface is capable of wrapping around the front of a user's face with a portion configured to be overlaying a user's cheek with said inner surface configured to be concave-like to approximately conform to the topology of the cheek region of a user so as provide a user with substantial protection to shield regions a of face from sunlight and other harmful ultraviolet radiation where each of the pair of cheek shields is connected to one of terminuses of the pair of extension arms, the pair of cheek shields, the nose bridge and the pair of extension arms comprise a continuous one piece construction of a same material whereby the facial accessory is adapted for when the pair of extension arms are in a state of having an increased spread distance between their terminuses there is a force urging the cheek shields inward that presses the pair of cheek shields against the face of a user to have some stabilizing effect of the facial accessory on the face of the user;

c a pair of temple arms extending away from the rearward boundary of each of the cheek shields where each temple arm extends a distance so as to be capable of resting on the top of a user's ears, has a hook region capable of engaging the rear of a user's ear and an extension length adjusting means for adjusting the distance that the temple arm extends between the rearward boundary of the cheek shield and the back of a user's ear.

7. The facial accessory of claim 6 where the extension length adjusting means is comprised of a row of a plurality of spaced apart holes and a corresponding row of a plurality of spaced apart posts with posts conformingly fitting into holes with a friction fit whereby the distance that the temple arm extends between the rearward boundary of the cheek shield and the back of a user's ear can be adjusted by selecting which posts are fitted into which holes.

8. The facial accessory of claim 6 where the cheek shield has at least one vent opening whereby there is cooling between a user's cheek and the cheek shield.

* * * * *